US008548679B2

(12) United States Patent
Hirata et al.

(10) Patent No.: US 8,548,679 B2
(45) Date of Patent: Oct. 1, 2013

(54) OVERTURN PREVENTION CONTROL DEVICE FOR TWO-WHEEL VEHICLE

(75) Inventors: Atsuhiko Hirata, Yasu (JP); Shigeru Tsuji, Omihachiman (JP); Tomonari Watanabe, Kusatsu (JP); Shigeki Fukunaga, Higashiomi (JP); Koichi Yoshikawa, Yasu (JP); Koji Kawai, Yasu (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 1272 days.

(21) Appl. No.: 12/145,585

(22) Filed: Jun. 25, 2008

(65) Prior Publication Data

US 2008/0249684 A1 Oct. 9, 2008

Related U.S. Application Data

(63) Continuation of application No. PCT/JP2006/321617, filed on Oct. 30, 2006.

(30) Foreign Application Priority Data

Jan. 27, 2006 (JP) ..... 2006-018471

(51) Int. Cl.

| | |
|---|---|
| ***A01B 69/00*** | (2006.01) |
| ***B62D 6/00*** | (2006.01) |
| ***B62D 11/00*** | (2006.01) |
| ***B62D 12/00*** | (2006.01) |
| ***B63G 8/20*** | (2006.01) |
| ***B63H 25/04*** | (2006.01) |
| ***G05D 1/00*** | (2006.01) |
| ***G06F 7/00*** | (2006.01) |
| ***G06F 17/00*** | (2006.01) |
| ***G06F 19/00*** | (2011.01) |
| ***B60G 23/00*** | (2006.01) |
| ***B62C 3/00*** | (2006.01) |
| ***B62K 25/00*** | (2006.01) |

(52) U.S. Cl.
USPC ..... 701/41; 701/37

(58) Field of Classification Search
USPC ..... 701/41, 37
See application file for complete search history.

(56) References Cited

U.S. PATENT DOCUMENTS

| | | | | |
|---|---|---|---|---|
| 7,610,131 | B2 * | 10/2009 | Kojima | 701/38 |
| 2004/0128060 | A1 * | 7/2004 | Park | 701/124 |
| 2005/0046274 | A1 * | 3/2005 | Banno et al. | 303/147 |
| 2006/0085111 | A1 | 4/2006 | Kojima | |

FOREIGN PATENT DOCUMENTS

| | | | |
|---|---|---|---|
| JP | 62-238183 | A | 10/1987 |
| JP | 07-215258 | A | 8/1995 |

(Continued)

OTHER PUBLICATIONS

Official Communication issued in International Patent Application No. PCT/JP2006/321617, mailed on Jan. 23, 2007.

*Primary Examiner* — Thomas Tarcza
*Assistant Examiner* — Imran Mustafa
(74) *Attorney, Agent, or Firm* — Keating & Bennett, LLP

(57) ABSTRACT

An overturn prevention control device for a two-wheel vehicle having a vehicle body, a front wheel, an actuator that steers the front wheel, a rear wheel, and a rear-wheel driving portion, includes an angular velocity sensor and a control unit arranged to output a steering angle command signal for controlling the actuator. The angular velocity sensor includes a detection axis, is mounted on the vehicle body such that the detection axis is downwardly inclined at a predetermined angle relative to a forward direction of the vehicle body, and detects an angular velocity about the detection axis. The angular velocity detected by the angular velocity sensor includes an angular velocity in a lateral direction of inclination and an angular velocity in an azimuthal direction. The zero-set error and offset noise are incorporated into the azimuth angle command. Thus, the two-wheel vehicle can be prevented from overturning.

4 Claims, 8 Drawing Sheets

(56) References Cited

FOREIGN PATENT DOCUMENTS

| | | | |
|---|---|---|---|
| JP | 2577593 | Y2 | 7/1998 |
| JP | 2005-348373 | A | 12/2005 |
| JP | 2006-020652 | A | 1/2006 |
| WO | WO 2004054678 | A1 * | 7/2004 |

* cited by examiner

OVERTURN PREVENTION CONTROL DEVICE FOR TWO-WHEEL VEHICLE

BACKGROUND OF THE INVENTION

1. Field of the Invention

The present invention relates to an overturn prevention control device for a two-wheel vehicle, and in particular, to an overturn prevention control device for a two-wheel vehicle capable of traveling autonomously without a human driver.

2. Description of the Related Art

There are known autonomous vehicles without a human driver using an electric motor or an internal-combustion engine as a prime motor and being controlled wirelessly or automatically. When traveling straight, such a vehicle can maintain its balance by steering right for a rightward tilt of the body of the vehicle and steering left for a leftward tilt of the vehicle body. When traveling around a curve, the vehicle can set a target value for a tilt angle of the vehicle body to a direction inclined from a vertical direction, and can steer right for a rightward tilt and steer left for a leftward tilt by using the set angle as the reference. In either case, it is necessary to estimate a tilt angle of the vehicle body.

Japanese Registered Utility Model No. 2577593 describes an autonomous vehicle without a human driver, the autonomous vehicle being capable of stably traveling in a manner that is approximated to an actual machine and in various modes from low to high speeds. This autonomous driverless vehicle includes a frame of a vehicle body, a drive wheel disposed at an end of the frame and rotatable via a primary motor, and a fork mounted to another end of the frame and supporting a steerable wheel so as to allow the steerable wheel to be freely driven and also includes an angular velocity sensor that outputs an angular velocity signal for a fall angle of the vehicle body, an arithmetic unit that generates a steering angle control signal, and an actuator that changes an angle of travel of the steered wheel in accordance with the steering angle control signal output from the arithmetic unit. The arithmetic unit includes an angular velocity command value generating unit arranged to generate an angular velocity command value on the basis of an externally provided travel control signal indicating an angle of travel of the steered wheel, a control signal generating unit arranged to generate a steering angle control signal to be supplied to the actuator on the basis of the deviation between an angular velocity signal being a detection signal of the angular velocity sensor and the angular velocity command value being an output from the angular velocity command value generating unit, and a feedback unit arranged to feed the steering angle control signal generated by the control signal generating unit back to the angular velocity command value generating unit. The actuator generates a steering control signal to control the steered wheel in a direction in which a deviation in fall angular velocity of the vehicle body during travel is reduced in accordance with the steering angle control signal from the arithmetic unit.

When the vehicle body falls, the direction of the steered wheel is controlled in a direction in which the fall angle is reduced. In such an autonomous driverless two-wheel vehicle, the steering angle control signal to be supplied to the actuator is generated based on the deviation between the detection signal of the angular velocity sensor and the angular velocity command value generated based on the externally provided travel control signal indicating an angle of travel of the steered wheel. However, obtaining a proper angular velocity command value from an angle of travel of the steered wheel and obtaining a steering angle directly from the deviation between a detected angular velocity value and the angular velocity command value require complicated computations and many parameters. This leads to a complicated control, which makes it difficult to perform stable autonomous travel.

One example of a relatively simple control method for preventing a two-wheel vehicle from overturning is illustrated in FIG. 7. In this method, an angular velocity $\omega_1$ in a lateral direction of inclination of a vehicle body is obtained using an angular velocity sensor 20, the angular velocity $\omega_1$ is integrated by use of an integrator 21 to obtain an inclination angle $\theta_f$ in the lateral direction of inclination of the vehicle body, the deviation between the obtained inclination angle $\theta_f$ and an inclination angle command value $\theta_r$ is input into arithmetic means 22 having a proportional gain $G_1$ to generate a steering angle command value $\delta_r$, and the generated command value $\delta_r$ is output to an actuator 23. This method obtains a steering angle from the deviation in inclination angle using the proportional gain $G_1$. Therefore, it is advantageous in that the computation is simple and, because not many parameters are required, the method is executable in a relatively simple manner.

However, an angular velocity sensor typically has a deviation (drift) in the detection signal due to changes in environmental temperature or a lapse of time, and this has adverse effects such as an offset. Together with the offset, external noise entering the angular velocity sensor 20 affects an angular velocity detection signal. In addition, if the vehicle body is already inclined when the vehicle starts traveling, it affects the inclination angle $\theta_f$ as a zero-set error $\theta_0$. Such problems may occur in not only the control method illustrated in FIG. 7 but also the control method described in Japanese Registered Utility Model No. 2577593.

FIG. 8 is an actual control block diagram in which error factors (zero-set error $\theta_0$ and offset noise $\Delta$) are added to the block diagram illustrated in FIG. 7. As illustrated in FIG. 8, the zero-set error $\theta_0$ is applied to the inclination angle $\theta_f$, and the offset noise $\Delta$ is applied to the angular velocity $\omega_1$.

FIG. 9 is an equivalent block diagram into which the block diagram illustrated in FIG. 8 is rewritten. As illustrated in FIG. 9, the zero-set error $\theta_0$ is directly applied to the inclination angle command value $\theta_r$, and the integral of the offset noise $\Delta$ is also applied to the inclination angle command value $\theta_r$. As a result, the zero-set error urges the vehicle body to incline even when the inclination angle command value $\theta_r$ is zero, so the path taken by the two-wheel vehicle is a curve. The integral of the offset noise $\Delta$ affects the inclination angle command value $\theta_r$, and the two-wheel vehicle obeys the inclination angle command value $\theta_r$ including the integral of the offset noise $\Delta$, so the actual inclination angle continues to increase. This causes the two-wheel vehicle to overturn in a short amount of time. As described above, although the control method illustrated in FIG. 7 is a simple control method, a problem in which it is difficult to perform stable autonomous travel due to the zero-set error $\theta_0$ and offset noise $\Delta$ exists in actual control.

SUMMARY OF THE INVENTION

To overcome the problems described above, preferred embodiments of the present invention provide an overturn prevention control device that allows a two-wheel vehicle to perform stable autonomous travel using a relatively simple control loop even when a zero-set error or offset noise is present.

A preferred embodiment of the present invention is an overturn prevention control device for a two-wheel vehicle and includes a vehicle body, a steerable front wheel provided at a front end of the vehicle body, an actuator that steers the front wheel, a rear wheel provided at a rear end of the vehicle body, and a rear-wheel driving portion that drives the rear wheel. The overturn prevention control device includes an angular velocity sensor and a control unit arranged to output a steering angle command signal $\delta_r$ for controlling the actuator. The angular velocity sensor has a detection axis, is mounted on the vehicle body such that the detection axis is downwardly inclined at a predetermined angle relative to a forward direction of the vehicle body, and detects an angular velocity $\omega$ about the detection axis. The control unit includes an integration unit arranged to integrate the angular velocity $\omega$ to obtain a first angle signal and a steering-angle-signal generating unit which generates the steering angle command signal $\delta_r$ using a deviation between the first angle signal and an externally provided second angle signal. The first angle is controlled so as to be close to the second angle by inputting of the steering angle command signal $\delta_r$ into the actuator.

A traditional angular sensor detects only an angular velocity $\omega_1$ in the lateral direction of inclination of the vehicle body, so the sensor is mounted such that its detection axis faces in the forward direction of the vehicle body (horizontal axis in the direction of travel of the vehicle body). In contrast, in preferred embodiments of the present invention, the angular velocity sensor is mounted on the vehicle body such that its detection axis is downwardly inclined relative to the forward direction of the vehicle body, so the angular velocity $\omega$ including the angular velocity $\omega_1$ component in the lateral direction of inclination of the vehicle body and the angular velocity $\omega_2$ component in the azimuthal direction is thereby detected. By integration of the angular velocity $\omega$ to obtain a first angle signal, generation of a steering angle command signal $\delta_r$ using the deviation between the first angle signal and an externally provided second angle signal, input of the steering angle command signal $\delta_r$ into the actuator, similar advantages to those obtained when an azimuth angle loop is set outside an inclination angle loop are obtainable. The zero-set error merely provides an initial value of the azimuth angle command with a deviation, and, for the offset noise, the integral thereof merely affects the azimuth angle command. That is, the zero-set error and the offset noise are incorporated into the azimuth angle command, and the inclination angle in the lateral direction of inclination is automatically controlled in the internal loop (inclination angle loop). Accordingly, the two-wheel vehicle can be prevented from overturning. Here, the inclination angle is an angle in the lateral direction of inclination of the vehicle body, and the steering angle is an angle that represents the direction of the front wheel. In addition, the azimuth angle is an angle that represents the direction of travel of the vehicle body, and the mounting angle is a downward tilting angle of the detection axis of the angular velocity sensor relative to the forward horizontal axis. Because the detection axis of the angular velocity sensor extends in the longitudinal direction, setting the detection axis using an angle of upward tilt to the backward horizontal axis is equal to the above.

According to a preferred embodiment, a mounting angle $\phi$ of the detection axis of the angular velocity sensor relative to a horizontal axis may preferably be an angle that allows an angular velocity $\omega_1$ in a lateral direction of inclination of the vehicle body and an angular velocity $\omega_2$ in an azimuthal direction to be extracted from the angular velocity $\omega$. The optimal value of the mounting angle $\phi$ varies depending on the structure of the vehicle body (e.g., the mass or the position of the center of gravity), the traveling speed of the two-wheel vehicle, and other factors. The mounting angle $\phi$ may preferably be at least an angle that allows the angular velocity $\omega_1$ in the lateral direction of inclination of the vehicle body and the angular velocity $\omega_2$ in the azimuthal direction to be extracted from the angular velocity $\omega$. If the mounting angle $\phi$ is too small, the angular velocity $\omega_2$ in the azimuthal direction would be difficult to extract. If the mounting angle $\phi$ is too large, the azimuth angle loop gain would be significantly large and control would be unstable.

According to a preferred embodiment of the present invention, the angular velocity $\omega$ detected by the angular velocity sensor can be represented by ($\omega=\omega_1 \cos\phi+\omega_2 \sin\phi$, where $\phi$ is a mounting angle of the detection axis relative to a horizontal axis, $\omega_1$ is an angular velocity in a lateral direction of inclination of the vehicle body, and $\omega_2$ is an angular velocity in an azimuthal direction.

According to a preferred embodiment of the present invention, the second angle signal can be provided by a target azimuth angle×sin $\phi$. That is, because the second angle signal being a command signal includes only an azimuth angle component, the direction of travel of the vehicle body can be directed in a target direction (orientation). In other words, the direction of travel is also controllable. In view of the azimuth angle command being affected by the offset and noise, the vehicle can also be accurately controlled to a target position by correction of the position of the vehicle using other position recognition devices.

As described above, according to the overturn prevention control device for a two-wheel vehicle in accordance with preferred embodiments of the present invention, the angular velocity sensor is mounted on the vehicle body such that its detection axis is downwardly inclined relative to the forward direction of the vehicle body. Therefore, similar advantages to those obtained when the azimuth angle loop is set outside the inclination angle loop are obtainable. This causes the zero-set error and the offset noise to be incorporated into the azimuth angle command, and causes the inclination angle in the lateral direction of inclination to be automatically controlled in the internal loop (inclination angle loop). Accordingly, the two-wheel vehicle can be reliably prevented from overturning.

Additionally, because the control unit arranged to output a steering angle command signal includes the integration unit and the simple arithmetic unit having a proportional gain, the structure is simple and easy to manufacture.

Other features, elements, steps, characteristics and advantages of the present invention will become more apparent from the following detailed description of preferred embodiments of the present invention with reference to the attached drawings

DETAILED DESCRIPTION OF PREFERRED EMBODIMENTS

Preferred embodiments of the present invention will be described below with reference to the drawings.

First Preferred Embodiment

Figure 1:
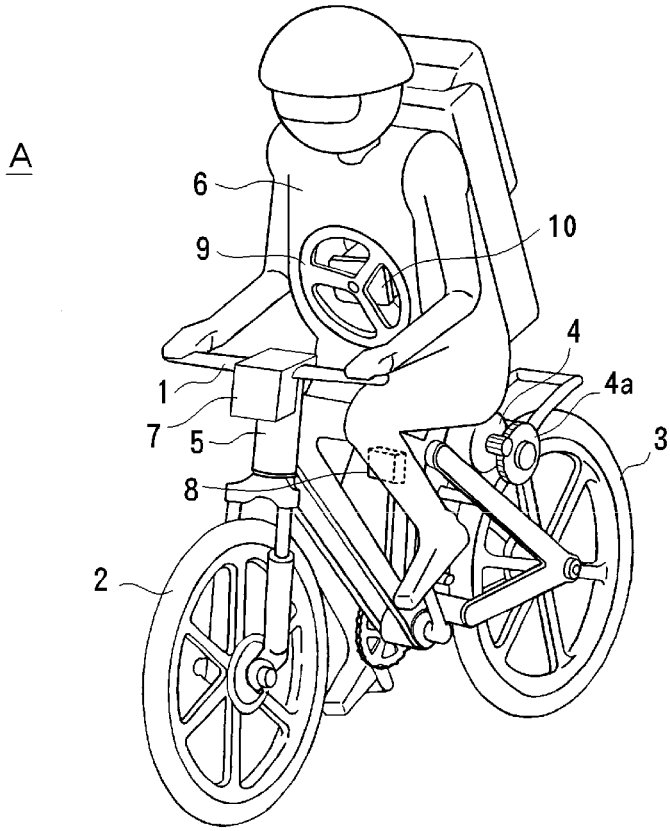
FIG. 1 is a perspective view of a preferred embodiment of a bicycle robot to which an overturn prevention control device according to the present invention is applied.
Figure 2:
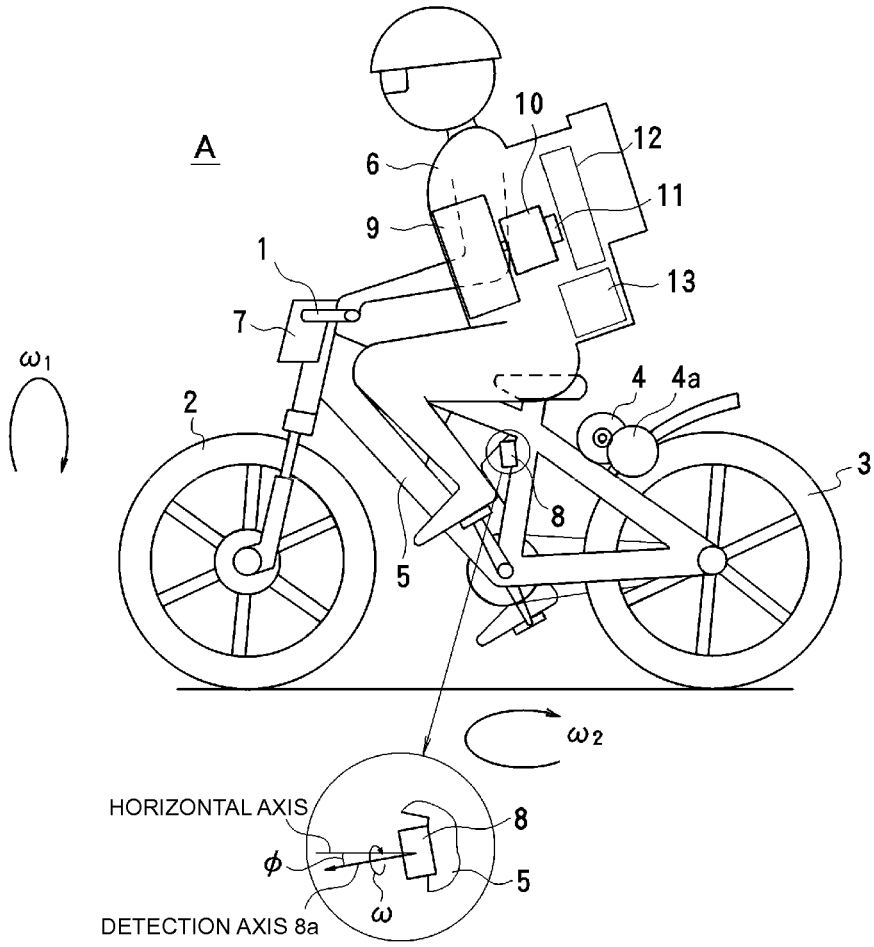
FIG. 2 is a side view of the bicycle robot.

FIGS. 1 to 3 illustrate a first preferred embodiment in which an overturn prevention control device according to the present invention is provided in a bicycle robot. The bicycle robot A includes a steering handlebar 1, a front wheel 2 steerable by the steering handlebar 1, a rear wheel 3, a rear-wheel driving motor 4 that drives the rear wheel 3, a frame 5 supporting the front wheel 2 and the rear wheel 3 such that they are freely rotatable, a doll 6 mounted on the frame 5, and an actuator 7 that steers the handlebar 1 (front wheel 2).

In this preferred embodiment, the actuator 7 is provided on the central portion of the handlebar 1. However, the actuator 7 may be provided at any position or may have any specific configuration as long as it can steer the front wheel 2. For example, the front wheel 2 may be steered by an arm of the doll 6 via the handlebar 1. In this preferred embodiment, the rear wheel 3 is driven by the rear-wheel driving motor 4 via a roller 4*a*. However, the present invention is not limited to this preferred embodiment. The rear-wheel driving motor 4 may drive the shaft of the rear wheel 3. Alternatively, the rear wheel 3 may be driven via a chain by the doll 6 pedaling the bicycle. In addition, an internal combustion engine or other suitable components may be used in place of the driving motor 4.

The frame 5 includes an angular velocity sensor 8 arranged such that a detection axis 8*a* thereof is downwardly inclined at a predetermined angle $\phi$ relative to the forward direction of the vehicle body of the bicycle robot A. The angular velocity sensor 8 can detect an angular velocity $\omega$ about the detection axis 8*a*. The mounting angle $\phi$ of the angular velocity sensor 8 (tilt angle of the detection axis 8*a* to a horizontal axis) may preferably be an angle that enables an angular velocity $\omega_1$ in a lateral direction of inclination of the vehicle body (including the frame 5 and the doll 6) and an angular velocity $\omega_2$ in an azimuthal direction to be extracted from the angular velocity $\omega$, and may preferably be, for example, on the order of approximately 4° to approximately 8°. The optimal value of the mounting angle $\phi$ varies depending on the structure of the vehicle body (e.g., the mass or the position of the center of gravity), the traveling speed, or other factors. Thus, the mounting angle $\phi$ is not limited to the above angle range.

Figure 3A:
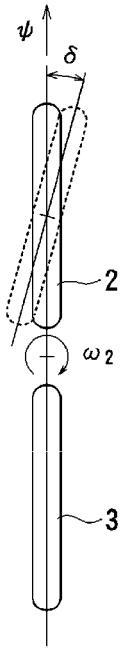
FIGS. 3A and 3B are illustrations that show definitions of symbols used for describing an overturn prevention control device according to a preferred embodiment of the present invention.
Figure 3B:
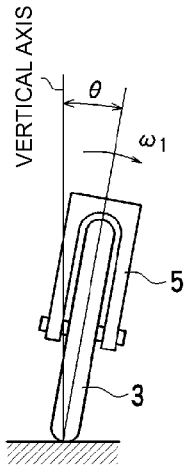

Here, the symbols used in the description below are defined. As illustrated in FIGS. 3A and 3B, the inclination angle $\theta$ is an angle in a lateral direction of inclination of the vehicle body (rear wheel 3) relative to a vertical direction. The steering angle $\delta$ is an angle that represents the direction of the front wheel relative to the direction of travel of the vehicle body. The azimuth angle $\psi$ is an angle that represents the direction of travel of the vehicle body relative to a reference direction (for example, the north). The mounting angle $\phi$ is a tilt angle of the detection axis 8*a* relative to the horizontal axis (in the forward direction), as previously described. The angular velocity $\omega$ is an angular velocity about the detection axis 8*a*. The angular velocity $\omega_1$ is an angular velocity in a lateral direction of inclination of the vehicle body. The angular velocity $\omega_2$ is an angle velocity in an azimuthal direction.

An inertia rotor 9, a balance motor 10 that drives the inertia rotor 9, and an encoder 11 that measures a rotation angle of the balance motor 10 are preferably mounted in the chest of the doll 6. The rotating shaft of each of the inertia rotor 9 and the motor 10 faces in a substantially longitudinal direction of the bicycle A. The substantially longitudinal direction indicates that it includes an exact longitudinal direction and can be slightly displaced upward or downward therefrom. A control substrate 12 that controls the rear-wheel driving motor 4, the steering actuator 7, the balance motor 10, and other components and a battery 13 are preferably mounted in the back of the doll 6.

During normal travel, the vehicle can be prevented from overturning by maintaining its balance by steering the handlebar 1 (front wheel 2). Specifically, the vehicle can be prevented from overturning by steering the handlebar 1 in a direction in which the vehicle body is inclined. During stops or while traveling at a very low speed, because it is difficult to maintain the balance by steering the handlebar 1 alone, the vehicle is controlled such that the balance is maintained by using a reaction occurring when the inertia rotor 9 is driven. Control for preventing an overturn using the inertia rotor 9 is described in Japanese Patent Application No. 2005-348373 filed by the applicant of the present invention. Thus, the description thereof is omitted herein.

Figure 4:
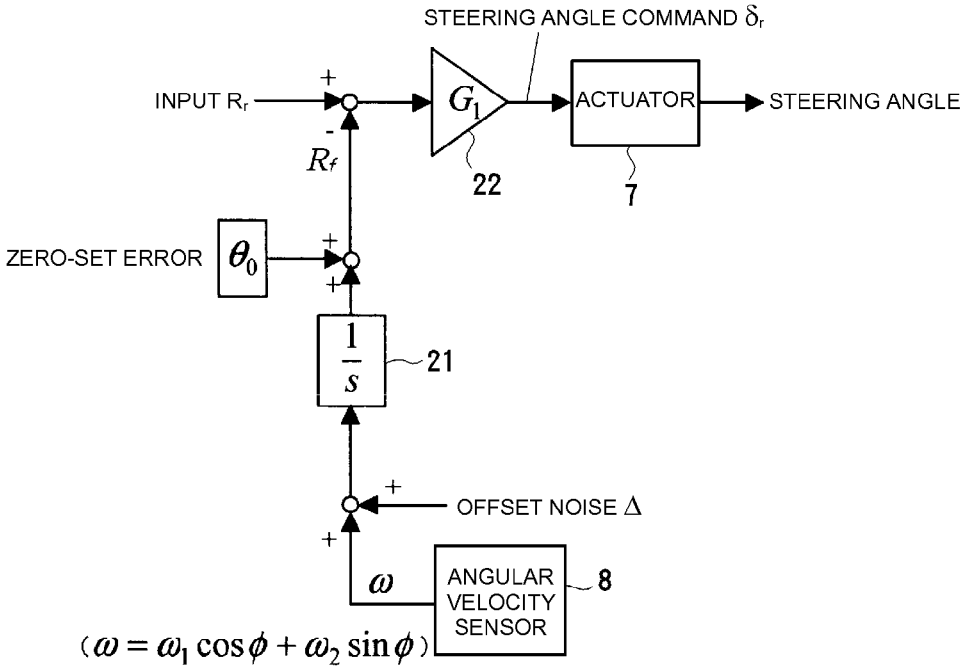
FIG. 4 is a block diagram of an overturn prevention control device according to a preferred embodiment of the present invention.
Figure 8:
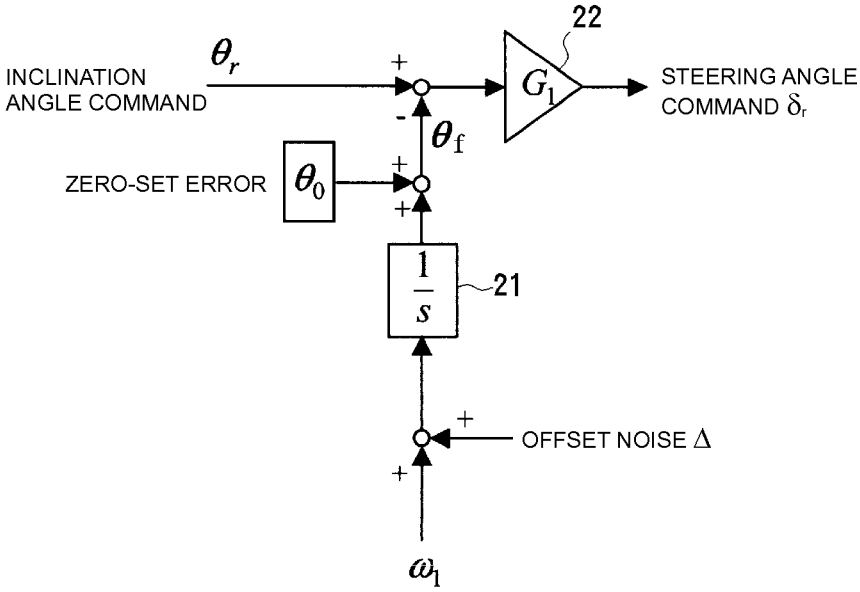
FIG. 8 PRIOR ART
FIG. 8 is an actual block diagram in which error factors are added to the block diagram of FIG. 7.
Figure 9:
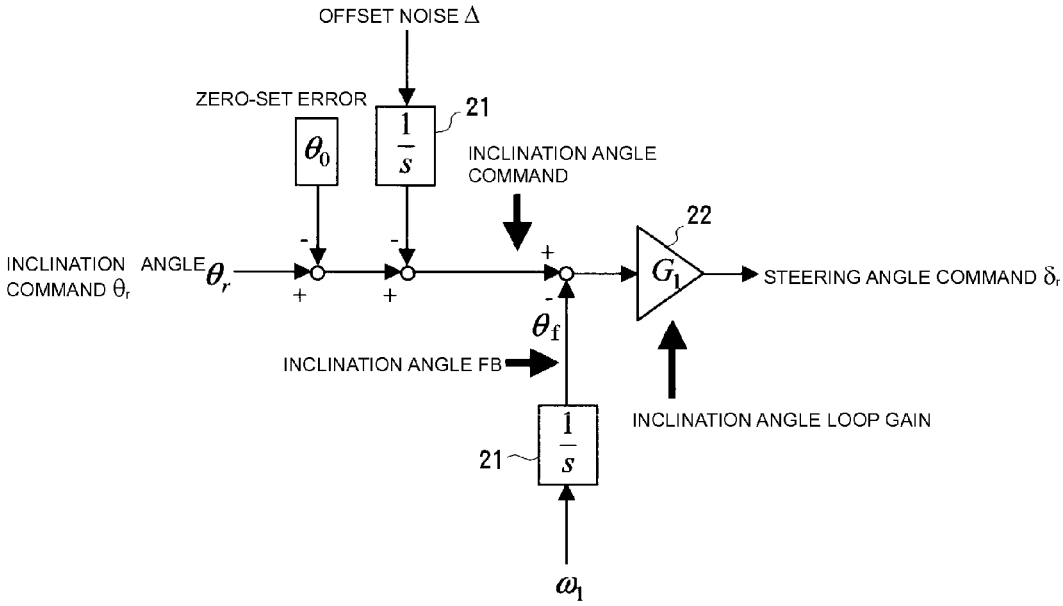
FIG. 9 PRIOR ART
FIG. 9 is an equivalent block diagram into which the block diagram of FIG. 8 is rewritten.

FIG. 4 illustrates one example of a control block for performing overturn prevention control while the bicycle robot A travels. In this control block, the integral of an output from the angular velocity sensor is preferably used as a feedback signal, as shown FIG. 8, the same reference numerals are used as in FIG. 8 for the same portions, and the redundant description is omitted.

The angular velocity $\omega$ detected by the angular velocity sensor 8 includes the angular velocity $\omega_1$ component in a lateral direction of inclination of the vehicle body and the angular velocity $\omega_2$ component in an azimuthal direction, and it can be represented by the following equation: $\omega=\omega_1 \cos \phi+\omega_2 \sin \phi$, where $\phi$ is the mounting angle.

As shown in FIG. 4, the offset noise signal $\Delta$ is added to the angular velocity signal $\omega$, and the result is integrated by an integrator 21. The zero-set error $\theta_0$ is added to the integrated signal, and the result becomes a feedback signal $R_f$. The deviation between the feedback signal $R_f$ and an input command signal $R_r$ is input into an arithmetic unit 22, and a steering angle command value $\delta_r$ is provided. The command value $\delta_r$ is output to the actuator 7, and the handlebar 1 (front wheel 2) is steered. The command signal $R_r$ will be described later.

Figure 5:
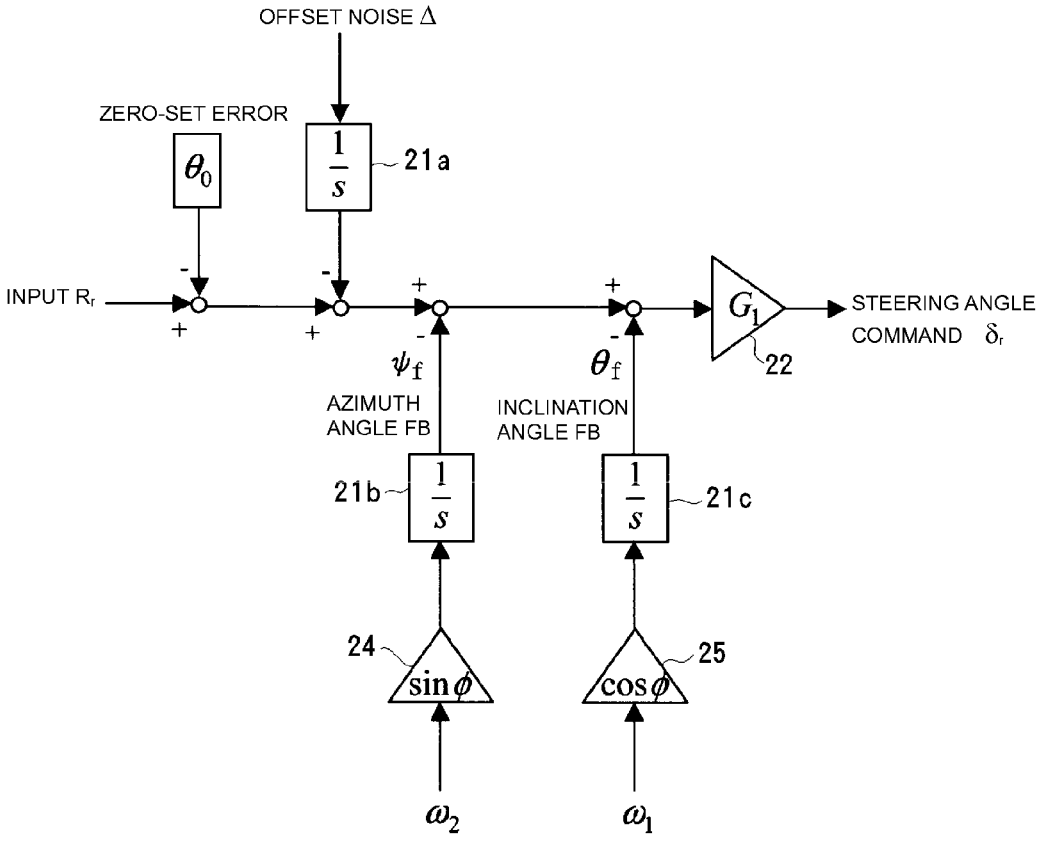
FIG. 5 is an equivalent block diagram in which the block diagram of FIG. 4 is resolved into angular velocity components.

FIG. 5 is an equivalent block diagram that illustrates the angular velocity $\omega$ in the block diagram of FIG. 4 such that the angular velocity $\omega$ is divided into the angular velocity $\omega_1$ component in the lateral direction of inclination and the angular velocity $\omega_2$ component in the azimuthal direction. As is apparent from FIG. 5, the zero-set error $\theta_0$ is directly applied to the input command signal $R_r$, and the integral of the offset noise $\Delta$ evaluated by an integrator 21*a* is also applied to the command signal $R_r$. A multiplication 24 is performed such that the angular velocity $\omega_2$ in the azimuthal direction is multiplied by a gain (=sin $\phi$), the result is integrated by an integrator 21*b*, and a feedback signal $\psi_f$ in the azimuthal direction is obtained. Similarly, a multiplication 25 is performed such that the angular velocity $\omega_1$ in the lateral direction of inclination is multiplied by a gain (=cos $\phi$), the result is integrated by an integrator 21*c*, and a feedback signal $\theta_f$ in the lateral direction of inclination is obtained.

Figure 6A:
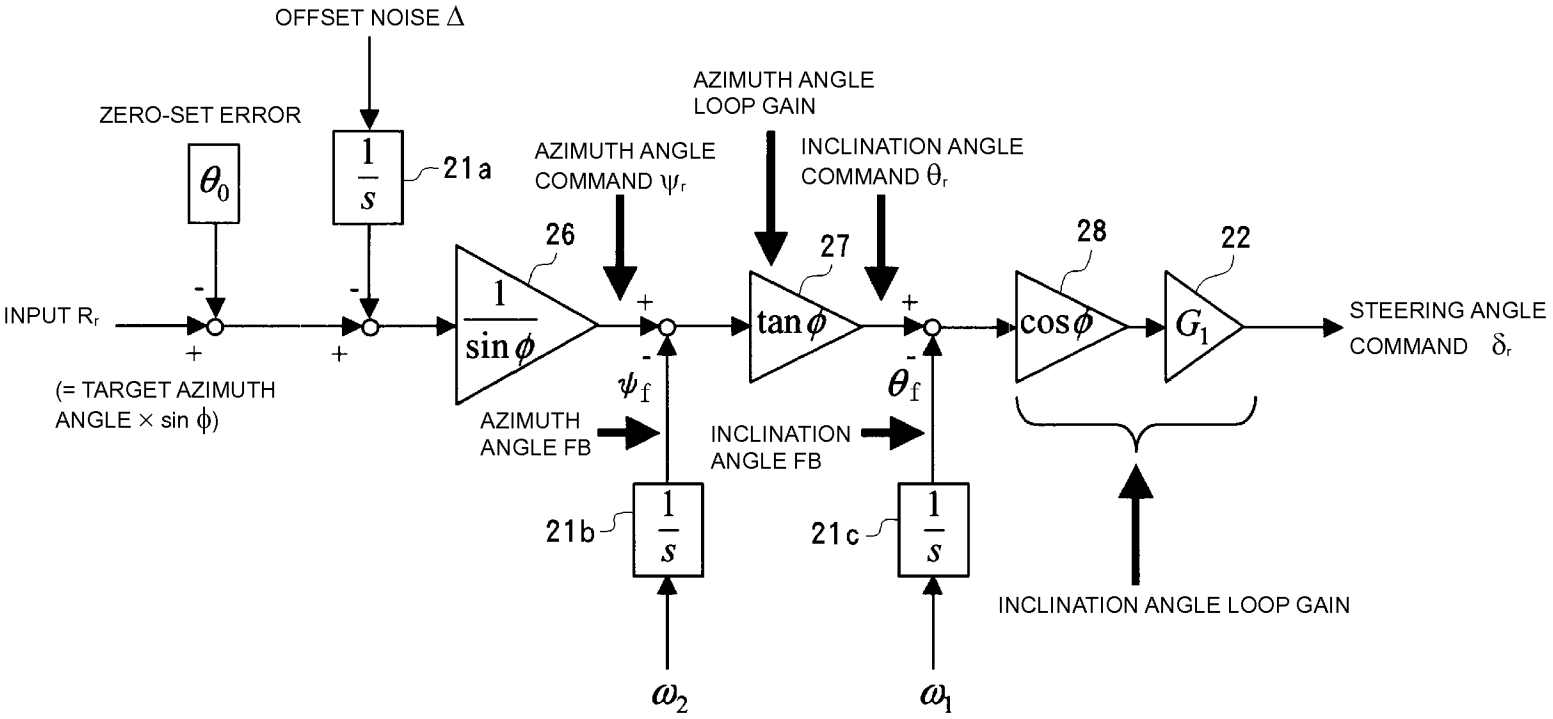
FIG. 6A is an equivalent block diagram into which the block diagram of FIG. 5 is further rewritten.
Figure 6B:
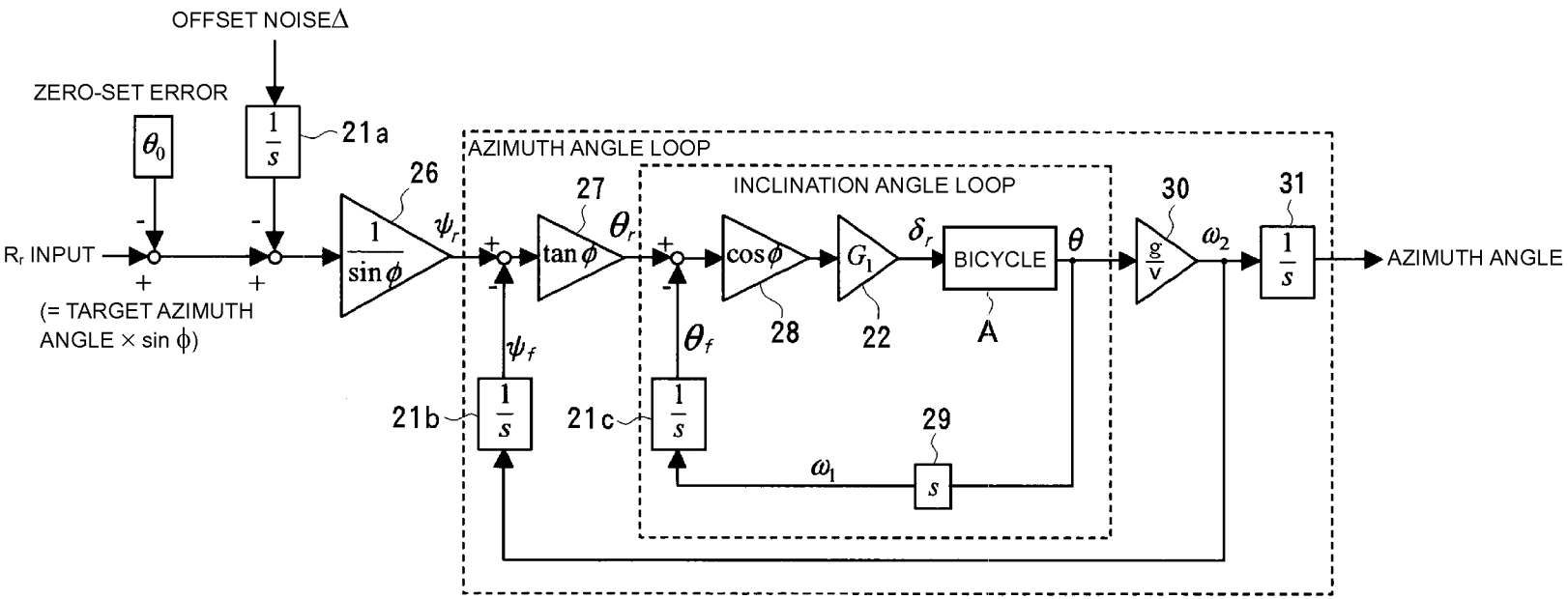
FIG. 6B is a block diagram in which a bicycle being in a steady travel state is added to FIG. 6A, illustrating an overall control system.

FIG. 6A is an equivalent block diagram into which the block diagram of FIG. 5 is further rewritten. FIG. 6B is a block diagram in which the bicycle in a steady travel state (input $R_r$ is input so as to increase at a constant speed) is added to FIG. 6A, illustrating an overall control system.

In FIG. 6B, the bicycle A is a bicycle model that includes the actuator 7 for steering the handlebar. When the handlebar 1 is steered in accordance with the handlebar steering angle command $\delta_r$ and a movement is performed by the bicycle A in response thereto, the inclination angle $\theta$ is thereby determined. When the inclination angle is $\theta$, the centripetal force produced when traveling in a curve is represented by mg tan $\theta \approx$mg $\theta$ (m: the mass of the bicycle, g: the acceleration of gravity).

The centrifugal force is represented as $mv\omega_2$ where v is the velocity of the bicycle A and $\omega_2$ is the azimuth angular velocity. Because these two forces are in balance, the following relationship is satisfied: $\omega_2=g\theta/v$.

As a result, as illustrated in FIG. 6B, an inclination angle loop can be written such that it is disposed within an azimuth angle loop, and thus, both the inclination angle loop and the azimuth angle loop can be stabilized.

Figure 7:
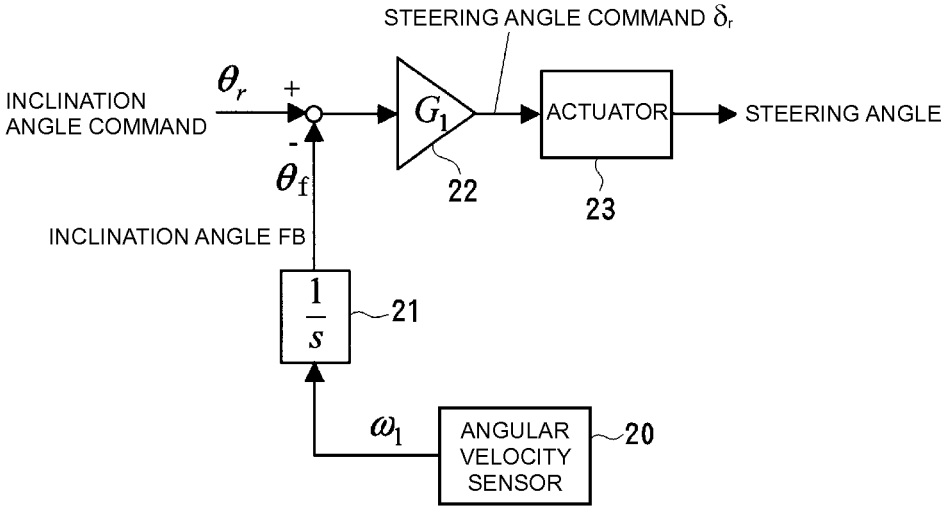
FIG. 7 PRIOR ART
FIG. 7 is an ideal block diagram of an overturn prevention control device being a reference example.

The detailed description of FIG. 6B will now be provided. After the zero-set error $\theta_0$ and the integral of the offset noise $\Delta$ are applied to the command signal $R_r$, a multiplication 26 is performed such that the resultant command value is multiplied by a gain (=1/sin $\phi$), and the azimuth angle command $\psi_r$ is obtained. The deviation between the azimuth angle command $\psi_r$ and the feedback signal $\psi_f$ obtained by the integration of the angular velocity $\omega_2$ in the azimuthal direction performed by the integrator 21*b* is determined. A multiplication 27 is performed such that this deviation ($=\psi_r-\psi_f$) is multiplied by the azimuth angle loop gain (=tan $\phi$), and the inclination angle command $\theta_r$ is obtained. The deviation between the inclination angle command $\theta_r$ and the feedback signal $\theta_f$ obtained by the integration of the angular velocity $\omega_1$ in the lateral direction of inclination performed by the integrator 21*c* is determined. When a multiplication 28 is performed such that this deviation ($=\theta_r-\theta_f$) is multiplied by a gain (=cos $\phi$) and a multiplication 22 is performed such that the resultant is multiplied by the gain $G_1$, the steering angle command $\delta_r$ is thereby obtained. In this case, the product of cos $\phi$ and $G_1$ is the inclination angle loop gain. The arithmetic unit 22 having the gain $G_1$ may be substantially the same as the arithmetic unit 22 having the inclination angle loop gain $G_1$ illustrated in FIG. 7.

The steering angle command $\delta_r$ is input into the bicycle A (including the actuator 7). The output inclination angle $\theta$ in the lateral direction of inclination is transformed into the angular velocity $\omega_1$ by a differentiator 29. A multiplication 30 is performed such that the inclination angle $\theta$ is multiplied by a gain g/v, and the angular velocity $\omega_2$ in the azimuthal direction is thereby obtained. When the angular velocity $\omega_2$ is integrated by an integrator 31, the azimuth angle is obtainable.

As shown in FIG. 6B, when the azimuth angle command $\psi_r$ is a constant, the inclination angle $\theta$ converges to approximately 0°. The azimuth angle loop gain (=tan $\phi$) can be freely set in accordance with the mounting angle $\phi$ of the angular velocity sensor 8. The response in the azimuthal direction can be freely changed. When a target azimuth angle×sin $\phi$ is input as the command signal $R_r$, the orientation can be controlled. The azimuth angle command is affected by the offset and the noise, and thus, the bicycle can be guided to a target position by correcting the position using image recognition performed by other position recognition devices, for example, a mounted camera, if required.

As described above, because the angular velocity $\omega$ output from the angular velocity sensor 8 includes the azimuth angle component $\omega_2$ and the angular velocity component $\omega_1$, similar advantages to those obtained when the azimuth angle loop is set outside the inclination angle loop are obtainable. The zero-set error merely provides an initial value of the azimuth angle command $\psi_r$ with a deviation. Therefore, if the vehicle body is inclined in the initial state, it can be immediately returned to an upright position ($\theta$=0°). For the offset noise, the integral thereof merely affects the azimuth angle command. That is, the zero-set error and the offset noise are incorporated into the azimuth angle command $\psi_r$, and the inclination angle is automatically controlled in the internal loop (inclination angle loop). Accordingly, the two-wheel vehicle can be reliably prevented from overturning.

In the foregoing preferred embodiment, the prevention of overturning of the bicycle robot is described. However, the present invention is not limited to this preferred embodiment. The present invention is applicable to an automatically controlled two-wheel vehicle with a human driver and other types of vehicle. In the foregoing preferred embodiment, an overturn prevention control using the inertia rotor 9 during stops or while the vehicle travels at a very slow speed is described. However, it is, of course, understood that the present invention is applicable to a bicycle that does not have the inertia rotor 9. In this case, if the vehicle body is inclined when the vehicle begins to travel, it affects the azimuth angle. In contrast to this, for a bicycle that controls its balance using the inertia rotor 9 during stops, the initial inclination angle $\theta$ of the vehicle body is substantially 0° and substantially no zero-set error occurs, so it can be accurately controlled to a target orientation.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. An overturn prevention control device for a two-wheel vehicle having a vehicle body, a steerable front wheel provided at a front end of the vehicle body, an actuator that steers the front wheel, a rear wheel provided at a rear end of the vehicle body, and a rear-wheel driving portion that drives the rear wheel, the overturn prevention control device comprising:

an angular velocity sensor having a detection axis, being mounted on the vehicle body such that the detection axis is downwardly inclined at a predetermined angle relative to a forward direction of the vehicle body, and arranged to detect an angular velocity $\omega$ about the detection axis, the predetermined angle being set such that the angular velocity $\omega$ detected by the angular velocity sensor includes an angular velocity $\omega_1$ in a lateral direction of inclination of the vehicle body and an angular velocity $\omega_2$ in an azimuthal direction; and a control unit arranged to output a steering angle command signal $\delta_r$ to control the actuator; wherein the control unit includes an integration unit arranged to integrate the angular velocity $\omega$ to obtain a first angle signal and a steering-angle-signal generating unit arranged to generate the steering angle command signal $\delta_r$ using a deviation between the first angle signal and an externally provided second angle signal; and the first angle is controlled by the control unit so as to be close to the second angle by inputting of the steering angle command signal $\delta_r$ into the actuator.

2. The overturn prevention control device for a two-wheel vehicle according to claim 1, wherein a mounting angle $\phi$ of the detection axis of the angular velocity sensor relative to a horizontal axis is an angle that enables an angular velocity $\omega_1$ in a lateral direction of inclination of the vehicle body and an angular velocity $\omega_2$ in an azimuthal direction to be extracted from the angular velocity $\omega$.

3. The overturn prevention control device for a two-wheel vehicle according to claim 1, wherein the angular velocity $\omega$ detected by the angular velocity sensor is represented by $$\omega=\omega_1 \cos \phi+\omega_2 \sin \phi$$

where $\phi$ is a mounting angle of the detection axis relative to a horizontal axis, $\omega_1$ is the angular velocity in the lateral direction of inclination of the vehicle body, and $\omega_2$ is the angular velocity in the azimuthal direction.

4. The overturn prevention control device for a two-wheel vehicle according to claim 3, wherein the second angle signal is determined by a target azimuth angle×sin $\phi$.

* * * * *